US007997467B2

(12) United States Patent
Hirabayashi et al.

(10) Patent No.: US 7,997,467 B2
(45) Date of Patent: Aug. 16, 2011

(54) ELECTRIC DRIVING TOOL

(75) Inventors: Shinji Hirabayashi, Anjo (JP); Jiro Oda, Anjo (JP)

(73) Assignee: Makita Corporation, Anjo (JP)

( * ) Notice: Subject to any disclaimer, the term of this patent is extended or adjusted under 35 U.S.C. 154(b) by 281 days.

(21) Appl. No.: 12/311,017

(22) PCT Filed: Sep. 13, 2007

(86) PCT No.: PCT/JP2007/067811

§ 371 (c)(1),
(2), (4) Date: Mar. 23, 2009

(87) PCT Pub. No.: WO2008/035606

PCT Pub. Date: Mar. 27, 2008

(65) Prior Publication Data

US 2009/0321495 A1 Dec. 31, 2009

(30) Foreign Application Priority Data

Sep. 21, 2006 (JP) ..... 2006-255666

(51) Int. Cl.
*B25C 1/06* (2006.01)

(52) U.S. Cl. ..... 227/131; 227/156; 227/134

(58) Field of Classification Search ..... 227/131, 227/134, 156

See application file for complete search history.

(56) References Cited

U.S. PATENT DOCUMENTS

| | | | | |
|---|---|---|---|---|
| 1,951,170 | A * | 3/1934 | Schwob | 74/50 |
| 2,487,530 | A * | 11/1949 | Dirksen | 173/53 |
| 2,869,824 | A * | 1/1959 | Hazak | 173/53 |
| 4,042,036 | A | 8/1977 | Smith et al. | |
| 4,121,745 | A | 10/1978 | Smith et al. | |
| 4,204,622 | A | 5/1980 | Smith et al. | |
| 4,323,127 | A * | 4/1982 | Cunningham | 173/53 |
| 4,721,170 | A | 1/1988 | Rees | |
| 4,747,455 | A | 5/1988 | Cunningham | |
| 4,832,328 | A | 5/1989 | Graham | |
| 4,854,492 | A | 8/1989 | Houck et al. | |
| 5,069,379 | A * | 12/1991 | Kerrigan | 227/131 |
| 5,098,004 | A | 3/1992 | Kerrigan | |
| 2005/0218183 | A1 | 10/2005 | Berry et al. | |

FOREIGN PATENT DOCUMENTS

| | | |
|---|---|---|
| DE | 40 40 508 A1 | 6/1991 |
| GB | 2 000 716 A | 1/1979 |
| JP | A-54-11577 | 1/1979 |
| JP | B2-59-49150 | 11/1984 |
| JP | A-62-114886 | 5/1987 |
| JP | A-2-145270 | 6/1990 |
| JP | A-6-179178 | 6/1994 |
| JP | A-2006-142392 | 6/2006 |
| JP | A-2006-192515 | 7/2006 |

OTHER PUBLICATIONS

Search Report issued in European Patent Application No. 07807218.8 mailed on Oct. 12, 2010.

* cited by examiner

*Primary Examiner* — Brian D Nash

(74) *Attorney, Agent, or Firm* — Oliff & Berridge, PLC

(57) ABSTRACT

A driving tool that has a driver support base. The driver support base includes a transmitting portion having a V-shape in cross section. The driver support base can be pressed by a press member to cause the transmitting portion to wedge between a pair of left and right drive wheels, so that a friction force is produced to move the driver support base.

11 Claims, 13 Drawing Sheets

ELECTRIC DRIVING TOOL

TECHNICAL FIELD

The present invention relates to a driving tool for driving driven pieces, such as nails or the like, by an electric motor disposed therein as a drive source.

BACKGROUND ART

For example, a nail driver generally uses compressed air as a drive source, and a large striking can be exerted by reciprocating a piston by compressed air. In contrast thereto, there is provided a nail driver for driving driven pieces, such as nails or the like, by reciprocating a driver (striking rod) for striking by using a an electric motor as a drive source. In the case of the driving tool of the electric type, measures for achieving a large striking force have been provided in the art. These various measures are described in, for example, Patent References 1 through 3 shown below. A technology disclosed in Patent Reference 1 is constructed for providing a striking force to a driver by bringing a drive wheel rotated by an electric motor into contact with a driver or separating the drive wheel therefrom by an electromagnetic actuator in order to clamp the driver between support rollers.

Further, a technology disclosed in Patent Reference 2 is constructed for providing a striking force to a driver by clamping the driver between drive wheels rotated by an electric motor, by bringing an idler wheel into contact with the driver or separating the idler wheel from the driver by a toggle mechanism.

Further, a technology disclosed in Patent Reference 3 is constructed for providing a large striking force resulting from a large friction resistance obtained by providing a plurality of V-shaped groove portions on a side of a reciprocating driver and, on the other hand, by providing a projected streak having a V-shaped cross section, which meshes with the V groove on the side of the driver, on a circumferential face of a drive wheel, in order to increase a contact area of the drive wheel with the driver.

Patent Reference 1: JP-A-2006-142392
Patent Reference 2: JP-A-6-179178
Patent Reference 3: US Patent Publication No. 2005/0218183

DISCLOSURE OF THE INVENTION

However, there known electric drives had the following problems. It is still difficult to provide the sufficient striking force even by the technologies disclosed in Patent Reference 1 and 2. Further, according to the technology disclosed in Patent Reference 3, it is necessary to provide the plurality of V-shaped groove portions on the side of the driver and, on the other hand, to provide the plurality of projected streaks having the V-shaped cross section and meshing with the groove portions on the circumferential face of the drive wheel, and in view of a necessity of bringing these in mesh with each other uniformly, a problem of need of high accuracy working is posed.

Hence, there is a need of an electric driving tool capable of effectively transmitting a rotational force of a drive wheel to a driver.

SUMMARY OF THE INVENTION

One aspect of the present invention can include a driving tool, in which a transmitting portion of a driver support base having a driver attached thereto for driving a driven member, such as a nail or the like, is clamped between the pair of left and right drive wheels, and, the driver support base is pressed by a press member so as to be brought into a state where the transmitting portion having a V-shape in cross section wedges between the drive wheels. In this way, because it is constructed to achieve a large friction force (striking force) by clamping the single transmitting portion having the V-shape in cross section between the pair of left and right drive wheels, and therefore, in comparison with a constitution of Patent Reference 3, in which a plurality of projected streaks having V-shapes in cross section are meshed with a plurality of V-shaped grooves, high working accuracy is not needed, and a large friction force can be achieved.

Further, the transmitting portion having the V-shape in cross section wedges between the pair of left and right drive wheels by pressing the driver support base by the press member, a large friction force is generated between the transmitting face and the drive wheels, so that a large striking force can achieved by reliably transmitting a rotational force of the drive wheels to the driver support base.

Rotational axes of the pair of left and right drive wheels may be arranged in a V-shape in the same manner as the two transmitting faces of the driver support base, and therefore, the peripheral faces of the two drive wheels can be defined as cylindrical tubular faces that are parallel with the rotational axes. Therefore, peripheral speeds (radius of rotation) of the peripheral faces of the two drive wheels are the same at any of positions on the peripheral faces. Therefore, no slippage of the peripheral faces of the two drive wheels on the transmitting faces of the driver support base may be caused, and also in this respect, the rotational forces of the two drive wheels are further reliably transmitted to the side of the driver support base and a large striking force can be achieved.

BRIEF DESCRIPTION OF THE DRAWINGS

FIG. 1 is a side view of an entire internal structure of a driving tool according to a first embodiment of the present invention.

FIG. 2 is a view of the internal structure of the driving tool according to the first embodiment of the invention as viewed from a direction of arrow (2) in FIG. 1.

FIG. 3 is a side view of the driving tool of the first embodiment. This figure shows the internal structure at a stage where a driver support base has reached a downward movement end to complete driving.

FIG. 4 is a sectional view taken along a line (4)-(4) in FIG. 2 and is cross-sectional view showing a state of wedging of a transmitting portion between left and right drive wheels.

FIG. 5 is a side view showing an operation of a press mechanism. This figure shows a state where a press member is not pressed against the driver support base.

FIG. 6 is a side view showing the operation of the press mechanism. This figure shows a state where the press member has been pressed against the driver support base.

FIG. 7 is a side view of a winding wheel for winding a return rubber.

FIG. 8 is a cross-sectional view of the winding wheel and is a view showing a fixing state of one end side of the return rubber.

FIG. 9 is a plane view of the driver support base, and is a view showing a fixing state of an end portion on the side of the driver support base of the return rubber.

FIG. 10 is a side view of the driver support base and is a view showing a fixing state of the driver support base side of the return rubber.

FIG. 11 is an enlarged view of a main portion of FIG. 4, and is a view showing a state of application of forces to the left and right drive wheels and the transmitting portion.

FIG. 12 is a cross-sectional view around a wedging region of a transmitting portion between drive wheels of a driving tool according to a second embodiment.

FIG. 13 is a side view of an entire internal structure of a driving tool according to a third embodiment of the present invention.

FIG. 14 is a side view around a drive section of the driving tool according to the third embodiment. This figure shows a stage, at which a driver support base is positioned at a standby position.

FIG. 15 is a side view around the drive section of the driving tool according to the third embodiment. This figure shows a stage, at which the driver support base starts moving downward.

FIG. 16 is a side view around the drive section of the driving tool according to the third embodiment. This figure shows a stage, at which the driver support base reaches a downward movement end.

FIG. 17 is a sectional view taken along line (17)-(17) in FIG. 14 and is a cross-sectional view of the drive section.

DETAILED DESCRIPTION OF THE INVENTION

Figure 1:
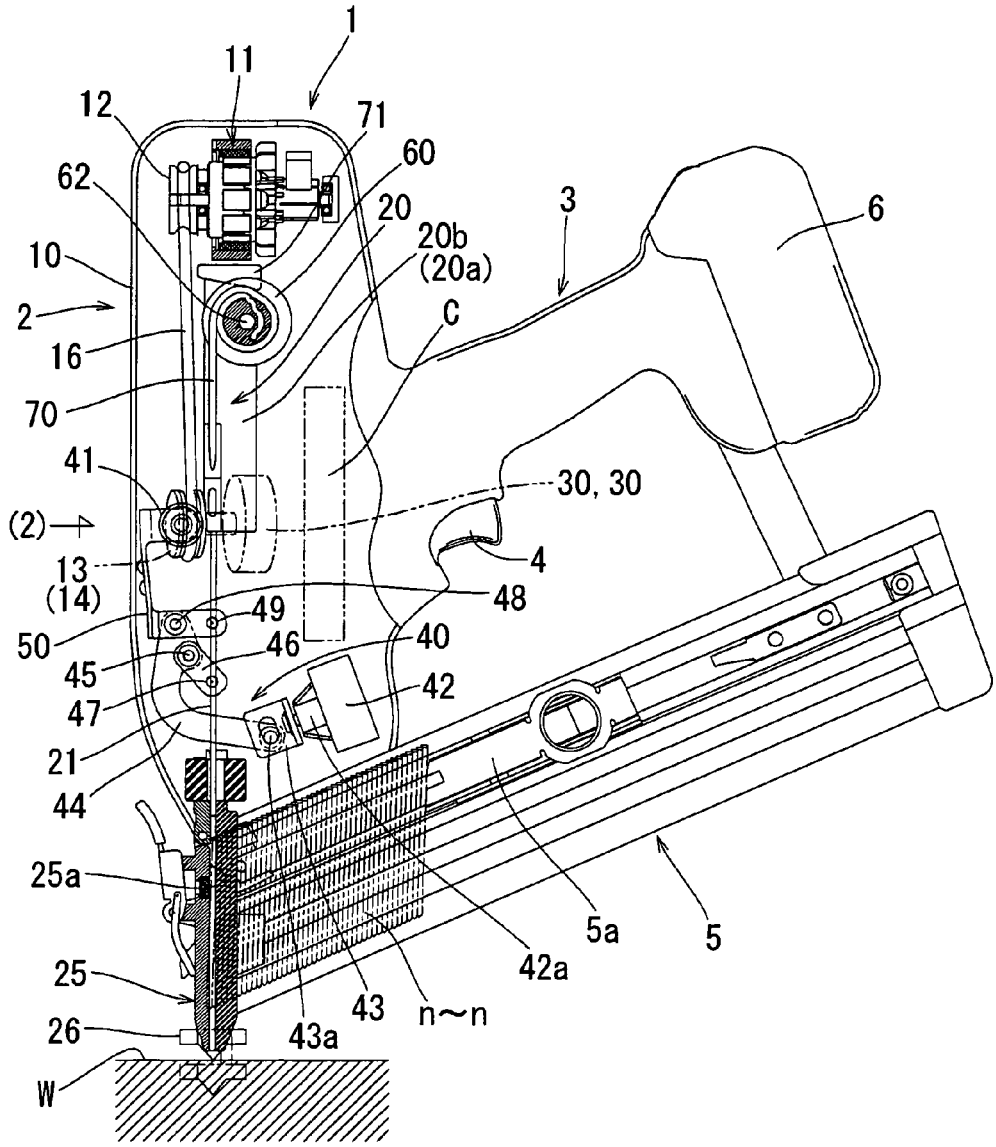
[FIG. 1]
Figure 2:
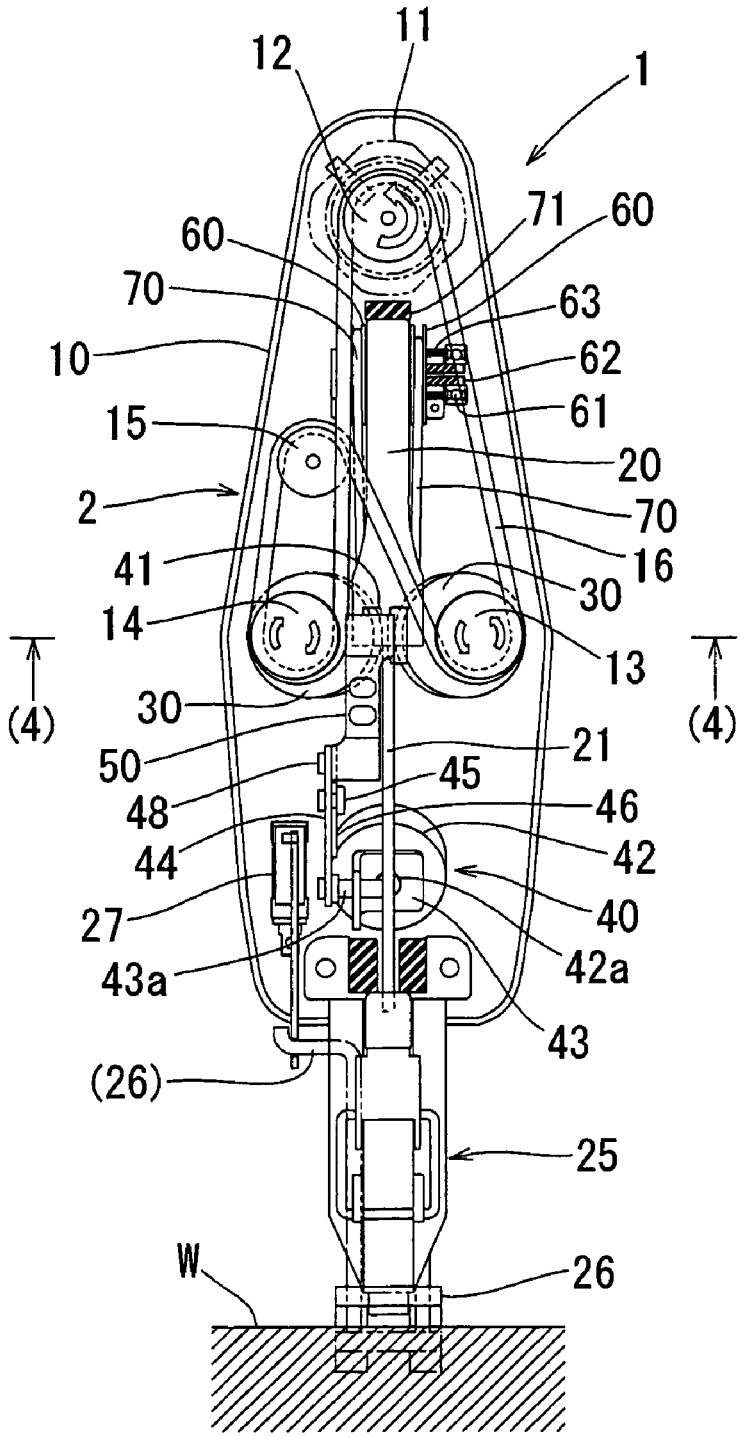
[FIG. 2]
Figure 3:
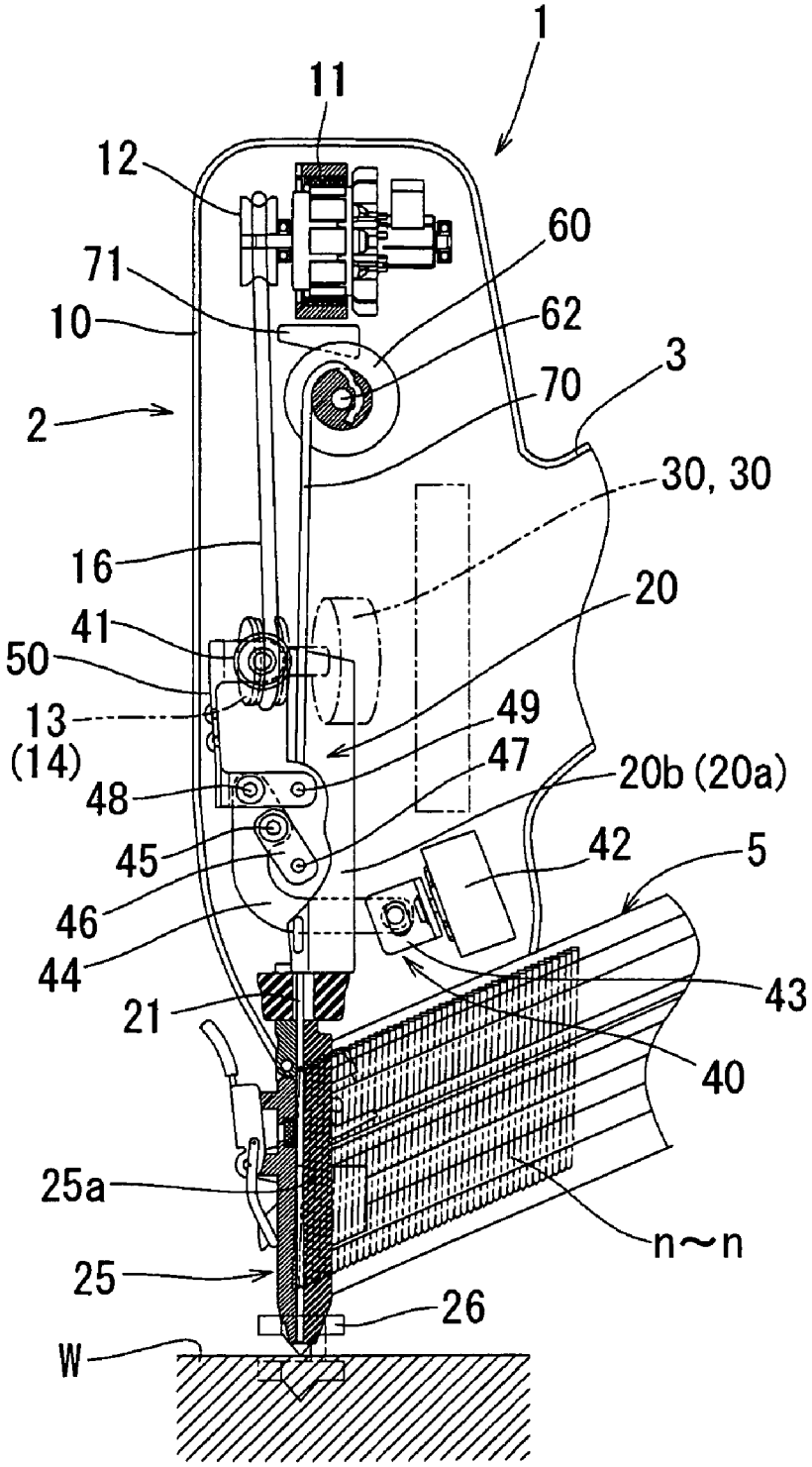
[FIG. 3]

Next, embodiments of the present invention will be explained in reference to FIG. 1 through FIG. 17. FIG. 1 through FIG. 3 show a driving tool 1 according to a first embodiment. The driving tool 1 can generally be divided into a main body portion 2 and a handle portion 3. The handle portion 3 is integrally provided in a state of being projected from a side portion of the main body portion 2 in a lateral direction. A base portion of the handle portion 3 is provided with a switch lever 4 of a type of trigger. Further, a magazine 5 containing a number of driven pieces (according to this embodiment, nails n through n are exemplified) is provided between the main body portion 2 and the handle portion 3 in a state of extending therebetween. The driving tool 1 of this embodiment is characterized in a mechanism of driving the nails n as driven pieces. The handle portion 3 and the magazine 5 are similar to the known structures, and no particular change is necessary to this embodiment, and therefore, a detailed explanation and illustration thereof will be omitted.

FIG. 1 shows a state where a front end portion of the main body portion 2 is oriented toward a nail driven member W. Therefore, a downward direction in FIG. 1 is a direction of driving the nail n and is a striking direction of the nail n.

The main body portion 2 includes a main body housing 10 made of resin, constituted by a two-split structure, and molded substantially in a shape of a cylindrical tube. A mechanism for striking the nail n is disposed within the main body housing 10. The handle portion 3 is integrally molded with a side portion of the main body housing 10. A battery pack 6 of charge type is mounted to a front end of the handle portion 3. An electric motor 11 as a drive source of the driving tool 1 is started by the battery pack 6 as a power source.

The electric motor 11 is disposed within a rear portion (upper portion in FIG. 1) of the main body housing 10. An output shaft of the electric motor 11 has a drive pulley 12 attached thereto. In correspondence with the drive pulley 12, two driven pulleys 13, 14 and one auxiliary pulley 15 are disposed at substantially a center in a longitudinal direction of the main body housing 10. The two driven pulleys 13, 14 are arranged symmetrically in a left and right direction relative to the driving direction.

At a substantially center of the main body housing 10, a driver support base 20 is supported by a slide support mechanism, not illustrated, to be movable along the driving direction. A driver 21 is supported on a front end (lower face in FIG. 1) of the driver support base 20. The driver 21 is extended to be long in a frontward direction (downward direction in FIG. 1). A driver guide 25 is attached to a front end of the main body housing 10. The driver guide 25 is provided with a drive hole 25*a* capable of inserting the driver 21 in a state of being penetrated to reach a lower end (front end) from an upper end thereof. The front end portion of the driver 21 reaches inside of the drive hole 25*a*.

The driver guide 25 is connected with a supply side front end portion of the magazine 5. The magazine 5 includes a pusher plate 5*a* for pushing nails n through n in a supply direction (left direction in FIG. 1). The nails n are supplied one by one to inside of the drive hole 25*a* of the driver guide 25 by the pusher plate 5*a*.

Figure 4:
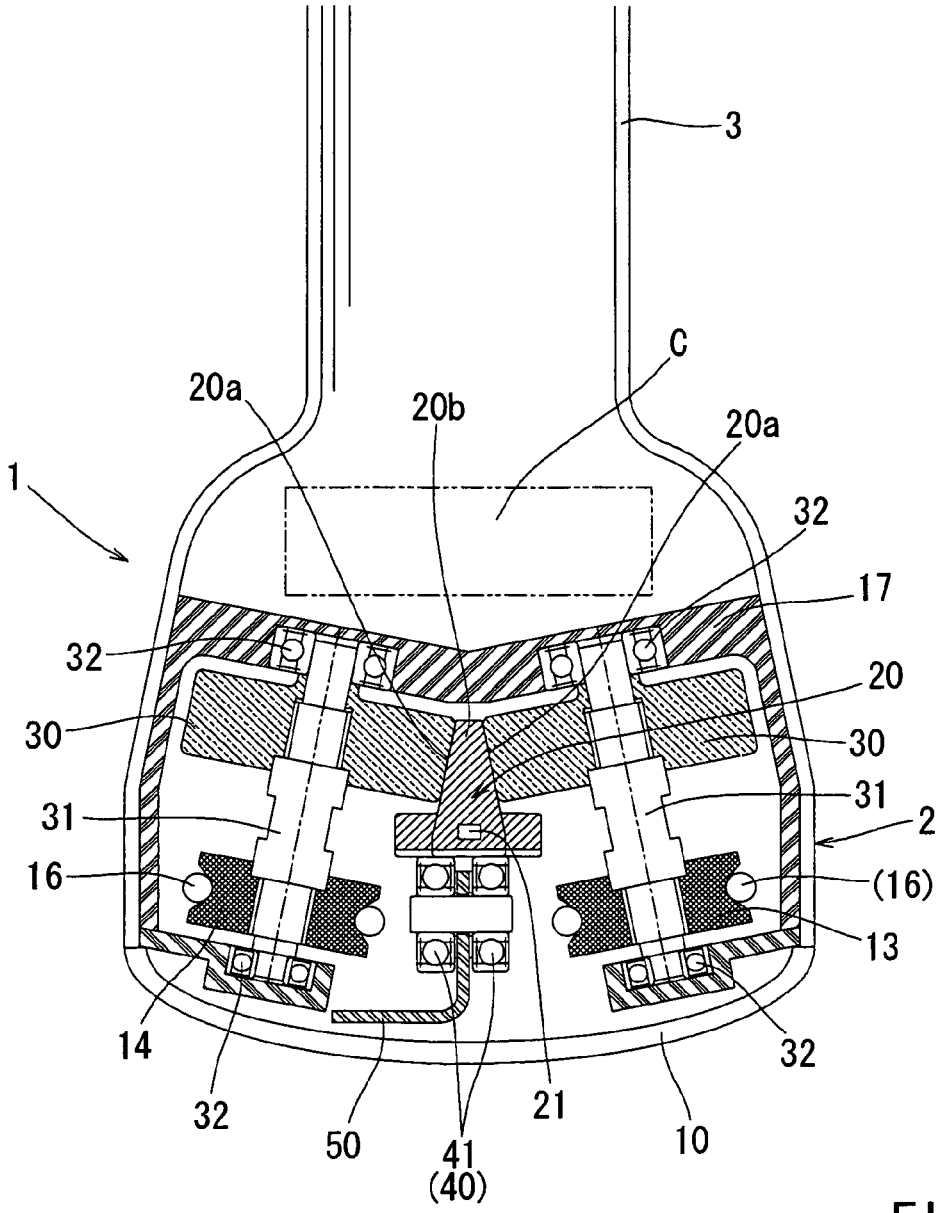
[FIG. 4]

The driver support base 20 includes a transmitting portion 20*b* having a V-shaped cross section. Transmitting faces 20*a*, 20*a* are provided at two left and right side portions with respect to the driving direction of the transmitting portion 20*b*. As shown in FIG. 4, the transmitting portion 20*b* having the V-shaped cross section is constituted by arranging the two transmitting faces 20*a*, 20*a* together in a V-shape.

The transmitting portion 20*b* is interposed between drive wheels 30, 30 on two left and right sides relative to the driving direction, and the drive wheels 30 are respectively in contact with the two transmitting faces 20*a*, 20*a*. The two drive wheels 30, 30 are supported coaxially and rotatably in unison with the driven pulleys 13, 14 by support shafts 31, respectively. When the driven pulleys 13, 14 are rotated, the two drive wheels 30, 30 are rotated.

As shown in FIG. 2, a single drive belt 16 extends between the drive pulley 12 attached to the output shaft of the electric motor 11 and the left and right driven pulleys 13, 14 and the auxiliary pulley 15. When the electric motor 11 is started in the striking direction, the left and right driven pulleys 13, 14 are rotated in directions opposite to each other by way of the drive belt 16, and therefore, the left and right drive wheels 30, 30 are simultaneously rotated in the opposite directions to each other at the same rotation speed.

As shown in FIG. 4, the support shafts 31, 31 rotationally supporting the left and right drive wheels 30, 30 are arranged together in a V-shape while their respective two end portions are supported by bearings 32 through 32. The respective bearings 32 through 32 are attached to a holder 17 fixed to the main body housing 10. The two drive wheels 30, 30 have cylindrical configurations having respective peripheral faces in parallel with axis lines (rotational axis lines) of the support shafts 31. The two support shafts 31, 31 are arranged at an angle of inclination equal to that of the transmitting faces 20*a* of the driver support base 20, and therefore, are in parallel with the transmitting face 20*a*. Therefore, the peripheral faces of the drive wheels 30, 30 are in contact with the transmitting faces 20*a* in a line contact state.

The driver support base 20 is moved in the driving direction (lower direction of FIG. 1) of the nail n by the rotation of the two drive wheels 30, 30 respectively in the directions opposed to each other when in the contact state with the transmitting faces 20*a* of the driver support base 20. By moving the driver support base 20 in the driving direction, the driver 21 is moved in unison therewith in the driving direction, and a head portion of one piece of nail n supplied into the drive hole 25*a* of the driver guide 25 is struck by the front end of the driver 21 and is driven out of the front end of the driver guide 25 during the moving process of the driver support base 20.

Figure 5:
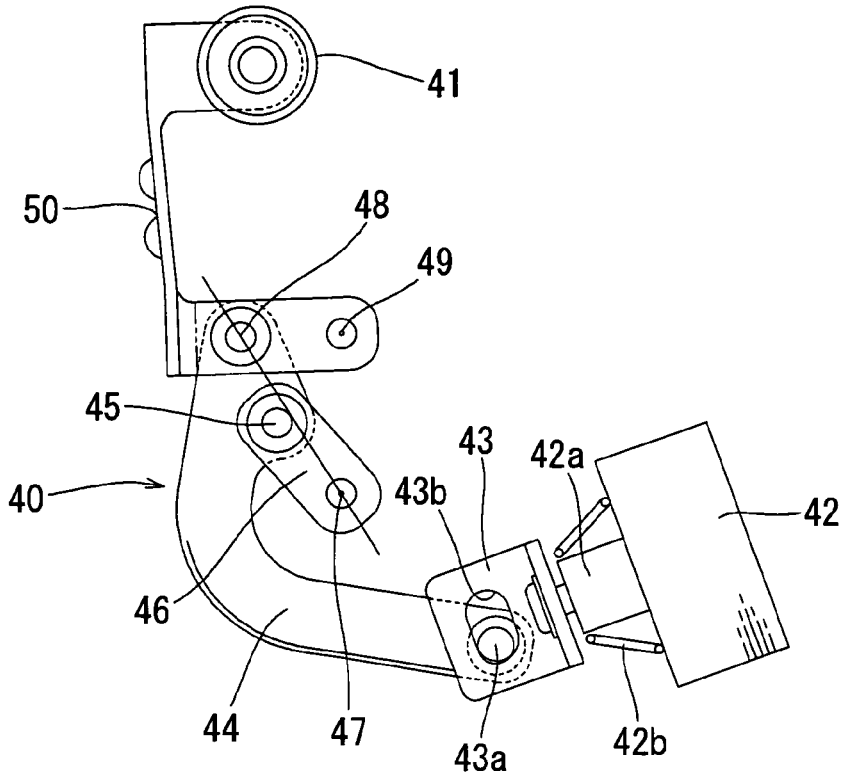
[FIG. 5]
Figure 6:
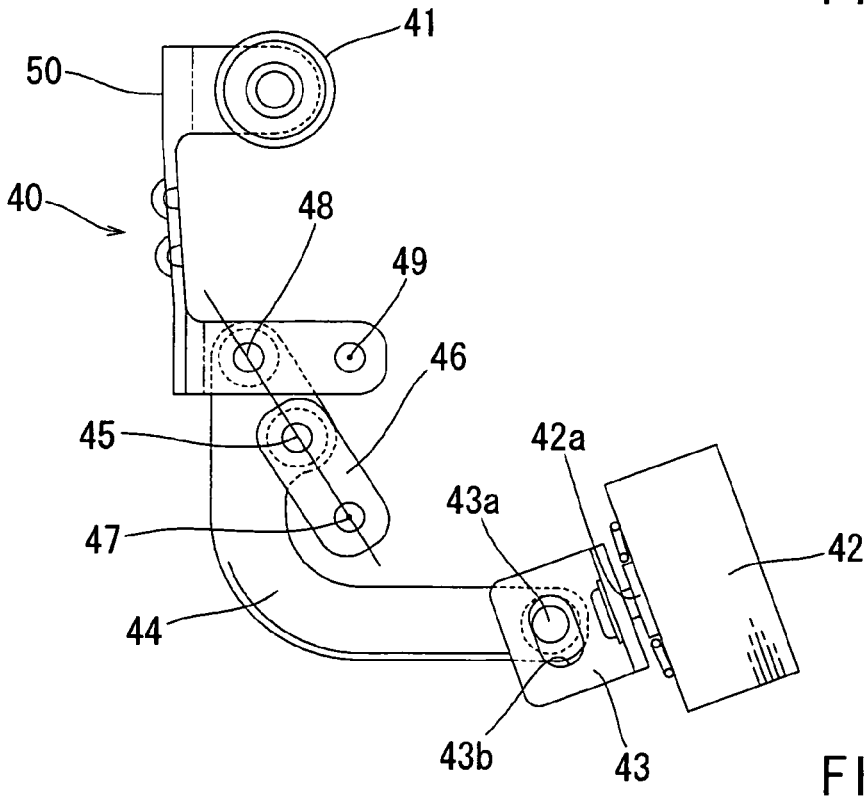
[FIG. 6]

The driver support base 20 is pressed in a direction of wedging the transmitting portion 20*b* between the two drive wheels 30, 30 (right side in FIGS. 1, 3, upper side in FIG. 4) by a press member 41. In the case of this embodiment, two rollers are used as the press member 41. A press mechanism 40 including the press member 41 will be hereinafter explained. Details of the press mechanism 40 are shown in FIGS. 5, 6.

The press mechanism 40 includes an electromagnetic actuator 42 as a drive source. The electromagnetic actuator 42 is arranged on a front side of the main body housing 10. An output shaft 42*a* of the electromagnetic actuator 42 is urged toward a projecting side by a compression spring 42*b*. When electric power is supplied to the electromagnetic actuator 42, the output shaft 42*a* is moved toward a retracting side against the compression spring 42*b*. When electric power is shut off, the output shaft 42*a* is returned toward the projecting side by the compression spring 42*b*.

A front end of the output shaft 42*a* of the electromagnetic actuator 42 is relatively rotatably connected with one end side of an operating arm 44 by way of a bracket 43. The bracket 43 is formed with a connecting hole 43*b* prolonged in a direction orthogonal to an extending and contracting direction of the output shaft 42*a*. The operating arm 44 is connected to the bracket 43 by way of a connecting shaft 43*a* inserted into the connecting hole 43*b*. Therefore, the one end side of the operating arm 44 is connected to the bracket 43 in a state of capable of being rotated by way of the connecting shaft 43*a* and capable of shifting the center of rotation within a movable range of the connecting shaft 43*a* defining the center of rotation within inside of the connecting hole 43*b*.

The operating arm 44 extends toward a rear side (upper side in FIGS. 1, 5, 6) as it is bent in an L-like shape. The other end side of the operating arm 44 is rotatably connected with one end side of a restricting arm 46 by way of a movable support shaft 45. The restricting arm 46 is rotatably supported by the main body housing 10 by way of a fixed support shaft 47. Further, the other end side of the operating arm 44 is rotatably connected with a press arm 50 by way of a movable support shaft 48. The press arm 50 is rotatably supported by the main body housing 10 by way of the fixed support shaft 49. The press member (press roller 41) is rotatably supported on a front end side with respect to the pivotal movement (upper end side of FIGS. 1, 5, 6) of the press arm 50.

According to the press mechanism 40 constituted in this way, in a standby state shown in FIG. 1 and FIG. 5, supply of electric power to the electromagnetic actuator 42 is shut off, and therefore, the output shaft 42*a* is returned to the projecting side by the compression spring 42*b*. In the standby state, a base end side (on the side of the connecting shaft 43*a*) of the operating arm 44 is shifted in a leftward obliquely downward direction in FIG. 1 and FIG. 5, and therefore, the restricting arm 46 is inclined in the counterclockwise direction about the fixed support shaft 47, the press arm 50 is inclined in the counterclockwise direction about the fixed support shaft 49, and as a result, the press member 41 is in a state of being away from a back face of the driver support base 20. Because the press member 41 is in a state of being away from the back face, the driver support base 20 does not wedge between the left and right drive wheels 30, 30.

In contrast thereto, when electric power is supplied to the electromagnetic actuator 42, the output shaft 42*a* is operated toward the retracting side against the compression spring 42*b*. Then, as shown in FIG. 3 and FIG. 6, the base end side of the operating arm 44 is shifted in a rightward obliquely upward direction, and therefore, the restricting arm 46 is inclined in the clockwise direction about the fixed support shaft 47 and the press arm 50 is inclined in the clockwise direction about the fixed support shaft 49, and as a result, the press member 41 is in a state of being pressed against the back face of the driver support base 20. Because the press member 41 is in a state of being pressed against the back face, the transmitting portion 20*b* of the driver support base 20 is in a state of being wedged between the left and right drive wheels 30, 30.

Further, under the state, as illustrated, the fixed support shaft 47 of the restricting arm 46, the movable support shaft 45 constituting a point of connecting with the operating arm 45, and the movable support shaft 48 constituting a point of connecting with the operating arm 45 are brought into a state of being positioned on one straight line. Therefore, the press arm 50 is locked in a state of pressing the press member 41 against the back face of the driver support base 20, so that the wedging state of the transmitting portion 20*b* between the two drive wheels 30, 30 is firmly maintained.

In this way, the press mechanism 40 has a function of pressing the press member 41 against the back face of the driver support base 20, locking the pressing state by a toggle mechanism constituted by the fixed support shaft 47 and the movable support shafts 45, 48, thereby maintaining the wedging state of the transmitting portion 20*b* between the drive wheels 30, 30. Because the transmitting portion 20*b* is brought to the state where the transmitting portion 20*b* firmly wedges between the drive wheels 30, 30, the rotational forces of the two drive wheels 30, 30 is efficiently transmitted as a drive force T for moving the driver support base 20 in the driving direction without causing slippage by the large friction.

Figure 11:
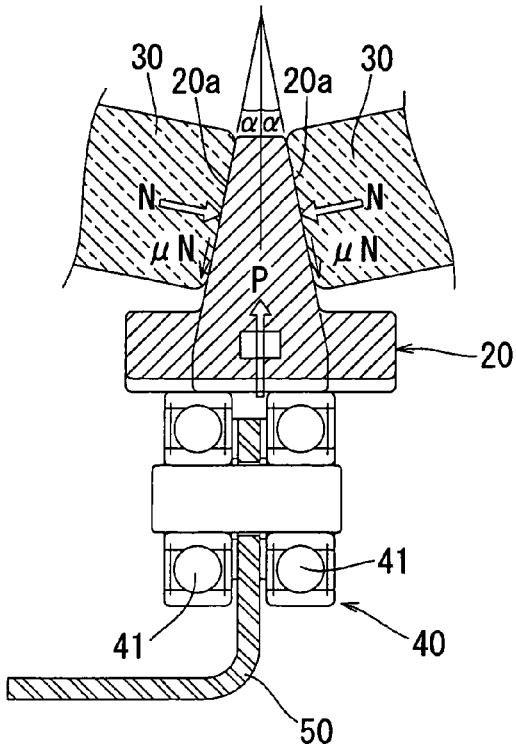
[FIG. 11]

Here, as shown in FIG. 11, the drive force T of the driver support base 20 achieved when a press force P is applied to the back face of the driver support base 20 by the press mechanism 40 is expressed by $T=2\ \mu N$. $\mu$ designates a friction coefficient of the transmitting face 20*a*, and N designates a force applied in a direction orthogonal to the transmitting face 20*a*.

Since $2N=P/(\sin\alpha+\mu\cos\alpha)$, when an equivalent friction coefficient is designated by $\mu(e)$, $\mu(e)=\mu/(\sin\alpha+\mu\cos\alpha)$ is derived from $T=\mu(e)P$.

In this embodiment, if the angle of inclination $\alpha=20°$ is set relative to the direction of driving of the transmitting faces 20*a*, 20*a*, in a case of the friction coefficient $\mu=0.2$ of the transmitting face 20*a*, $\mu(e)=0.38$ is resulted, and the achieved equivalent friction coefficient becomes substantially twice. Therefore, by bringing the drive wheels 30 into contact with the two transmitting faces 20*a*, 20*a* disposed in the V-shape and by bringing the transmitting portion 20*b* to wedge between the two drive wheels 30, 30 by the press force P applied against the driver support base 20 (wedging operation), the drive force T larger than that in the constitution described in Patent Reference 2 mentioned above (constitution of holding the driver between the press member and the drive wheel) can be achieved.

Figure 7:
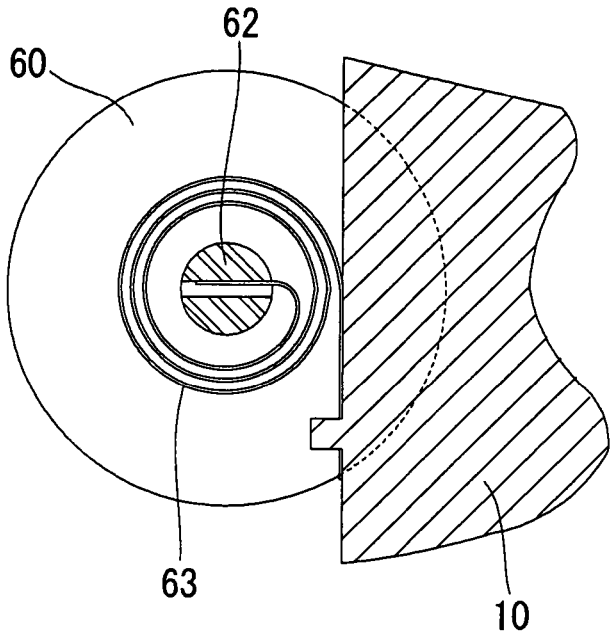
[FIG. 7]

Next, the rear portion (upper portion in FIG. 1) of the main body housing 10 is provided with winding wheels 60, 60 for upwardly returning the driver support base 20 and the driver 21 that have reached the downward movement end after finishing to drive the nail n. According to this embodiment, a pair of the winding wheels 60, 60 are provided on both left and right sides relative to the driving direction. The two winding wheels 60, 60 are fixed onto a winding shaft 62 supported rotatably by the main body housing 10 via bearings 61, 61. As shown in FIG. 7, a spiral spring 63 is interposed between the winding shaft 62 and the main body housing 10. The winding shaft 62 is urged in a winding direction by the spiral spring 63, and therefore, the two winding wheels 60, 60 are urged in the winding direction (clockwise direction in FIG. 7).

Figure 8:
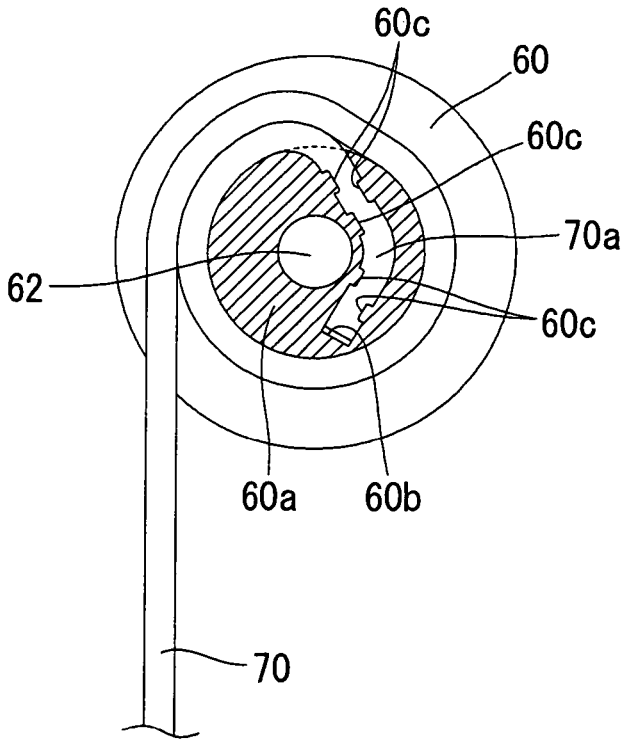
[FIG. 8]

The two winding wheels 60, 60 are respectively coupled with one end sides 70*a* of return rubbers 70 having elasticity and cord-like shapes. As shown in FIG. 8, each of the two winding wheels 60, 60 has a two-split structure in a direction of the rotational axis, and the one end side 70*a* of the return rubber 70 is coupled thereto in a state of being fitted into a groove portion 60*b* provided at the two-split face 60*a* and held between the two-split faces 60*a*, 60*a*. A plurality of projections 60*c* through 60*c* are provided within the groove portion 60*b*. The one end side 70*a* of the return rubber 70 is prevented from being removed from the groove portion 60*b* by being caught by the plurality of projections 60*c* through 60*c*, so that the one end side 70*a* of the return rubber 70 is further firmly coupled to the winding wheel 60. As shown in FIG. 8, the return rubber 70 is set with a length or the like so as to be wound on the winding wheel 60 by one time or more in a state of being not operated (wound state).

Figure 9:
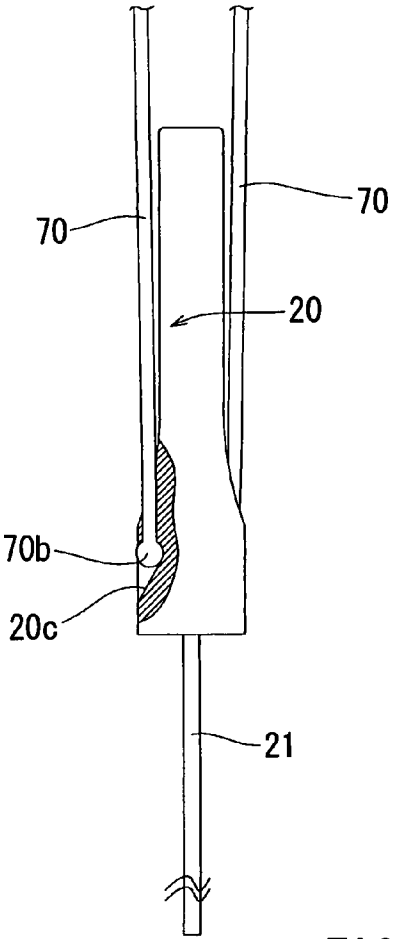
[FIG. 9]
Figure 10:
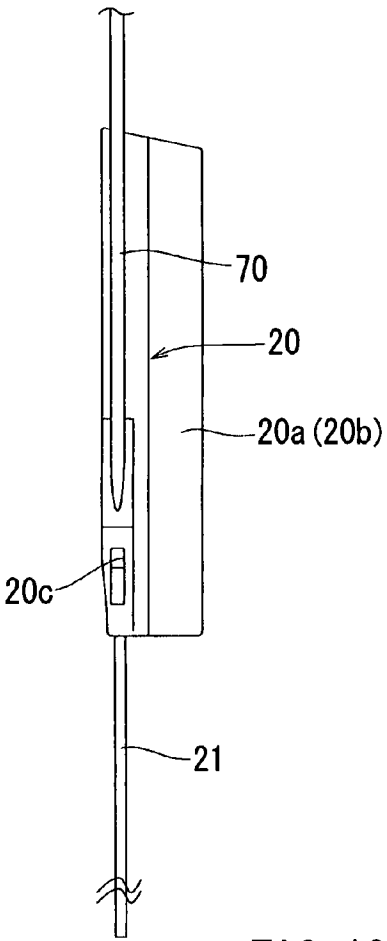
[FIG. 10]

The other end sides of the two return rubbers 70, 70 are respectively coupled to side faces of the driver support base 20. FIG. 9 and FIG. 10 show a state of coupling the return rubbers 70, 70 to the driver support base 20. The other ends of the two return rubbers 70, 70 are respectively provided with spherical engaging portions 70*b*. In contrast thereto, opposite side faces of the driver support base 20 are provided with engaging holes 20*c*, 20*c*. The other end side of the return rubber 70 is coupled to the driver support base 20 in a state of being firmly prevented from being removed through engagement of the spherical engaging portion 70*b* with the engaging hole 20*c* in the return direction.

The driver guide 25 is provided with a contact lever 26 for switching between effectiveness and ineffectiveness of the pulling operation of the switch lever 4. The contact lever 26 is supported by the driver guide 25 so as to be movable in the driving direction and has a lower end portion urged by a spring in a direction of projecting from the front end of the driver guide 25. In order to drive the nail n into the driven member W by using the driving tool 1, it is necessary to shift the contact lever 26 to the upper side relative to the driver guide 25 by bringing first, the contact lever 26 into contact with the driven member W and thereafter moving the driving tool 1 for bringing the front end of the driver guide 25 to be proximate to the driven member W. When the contact lever 26 is moved upward by the urge force of the spring, a limit switch 27 mounted within the main body housing 10 is turned ON, so that the electric motor 11 is started. A control apparatus C likewise mounted within the main body housing 10 carries out the control of them.

The control apparatus C receives input of an ON operating signal of the switch lever 4 and an ON signal of the limit switch 27 or the like and has a function of controlling the operation of starting or stopping the electric motor 11 and the electromagnetic actuator 42 based on the input.

According to the driving tool 1 of the first embodiment constituted as described above, when the contact lever 26 is moved relatively upward and the front end portion of the driver guide 25 moves to be proximate to the driven member W, the limit switch 27 is turned ON and the electric motor 11 is started in the driving direction. When the electric motor 11 is started in the driving direction, the drive pulley 12 is rotated in a direction indicated by an outline arrow (driving direction) in FIG. 2, and therefore, the left and right drive wheels 30, 30 are rotated in driving directions (directions opposed to each other) likewise indicated by outline arrows. When the left and right drive wheels 30, 30 are rotated in the driving directions, their rotational driving forces are applied to the driver support base 20 as the drive force T in the driving direction by way of a state of contact of the driver support base 20 with the transmitting faces 20*a*, 20*a*.

On the other hand, when the switch lever 4 is operated to be pulled after starting the electric motor 11, the electromagnetic actuator 42 is operated in a direction of pulling the output shaft 42*a* (pressing direction), and therefore, the operating arm 44 is shifted and the press arm 50 pivots in the pressing direction about the fixed support shaft 49, and therefore, the press members 41, 41 are pressed against the back face of the driver support base 20 (press force P). The press state is locked as the movable support shafts 45, 48 constituting the toggle mechanism are positioned on the one straight line as shown in FIG. 6, and therefore, the wedging state of the driver support base 20 between the left and right drive wheels 30, 30 is locked. Because the transmitting portion 20*b* of the driver support base 20 wedges between the left and right drive wheels 30, 30 by the press force P in this way, a large drive force T is generated for the driver support base 20 without causing the slippage therebetween In this way, according to the driving tool 1 of the first embodiment, it is constructed to provide the drive force T to the driver support base 20 by causing the V-shaped transmitting portion 20*b* to wedge between the pair of left and right drive wheels 30, 30, and therefore, in comparison with the constitution, in which the plurality of projected streaks having the V-shape cross section wedge into the plurality of V-shaped grooves as described in Patent Reference 3 mentioned above, a drive force T larger than that of the known constitution described in Patent References 1, 2 can be achieved, and therefore, a large striking force can be achieved, without need of high working accuracy.

As the driver support base 20 is moved in the driving direction by the large drive force T, the driver 21 is moved downward within the drive hole 25*a* of the driver guide 25 to strike the head portion of the nail n, and therefore, the nail n is driven into the driven member W.

When the operation of pulling the switch lever 4 is released after finishing the driving operation, the supply of electric power to the electromagnetic actuator 42 is shut off, and the output shaft 42*a* is returned toward the projecting direction by the compression spring 42*b*. When the output shaft 42*a* is returned to the projecting direction, as shown in FIG. 5, the operating arm 44 is shifted, the movable support shaft 45 is shifted from the position on the line connecting the fixed support shaft 47 and the movable support shaft 48 to release the toggle mechanism, further, the press arm 50 is inclined in the counterclockwise direction about the fixed support shaft 49, and the state of pressing the press members 41, 41 against the back face of the driver support base 20 is released.

When the pressing of the press members 41, 41 against the driver support base 20 is released, the driver support base 20 is pulled to the upper side by the return rubbers 70, 70 to return to the standby position shown in FIG. 1. The standby position of the driver support base 20 is restricted by a stopper 71. Further, a time period of supply of power to the electromagnetic actuator 42 (state of pressing the driver support base 20) is set to be 0.07 second by the control of the control apparatus C, and therefore, after finishing to drive, even if the operation of pulling the switch lever 4 is maintained as it is, the supply of power to the electromagnetic actuator 42 is automatically shut off. Therefore, in the case of transferring to the next operation, it is not necessary to operate to return the switch lever 4 rapidly, and an excellent operability is ensured in this respect. Further, the time period of supply of power to the electromagnetic actuator 42 may be set to be shorter to approximately 0.02 second.

The return rubbers 70, 70 respectively have their own elastic forces toward a contracting side, and are wound on the winding wheel 60 biased by the spring toward the winding side. Therefore, even in the case that the driver support base 20 is moved in the driving direction by a large stroke, the driver support base 20 can firmly be returned to the standby position, and further, by restraining fatigue of the return rubbers 70, 70, their durability can be improved.

Further, because this embodiment is constructed to use the spiral spring 63 for spring-urging the winding wheels 60, 60 in the rotation direction, loads (urge forces) at a position of an upward moving end and a position at a downward moving end of the driver 21 can be made to be equal to each other. When the other torsion spring, such as a torsion spring or the like, is used, there is a possibility of causing insufficient driving due to increase of the load at the position of the downward moving end, or of conversely causing insufficient winding at the position of the upward moving end. Further, when attempting to lower the change of load in the torsion spring, it is necessary to increase the number of turn or the coil diameter, and therefore, it is necessary to ensure a space therefor, and as a result, a problem of increase in size of the apparatus is caused. In this respect, downsizing of the apparatus can be achieved by using the spiral spring 63 as exemplified above. This effect is particularly prominent when the rotational angle is set to be large (about 360°) as in the embodiment.

Further, according to the driving tool 1 of the first embodiment, the support shafts 31, 31 of the drive wheels 30, 30 are arranged in parallel with the transmitting faces 20*a*, 20*a*, and therefore, the radii of rotation of the drive wheels 30, 30 are constant (circumferential speed is constant), and therefore, no slippage is caused between the drive wheels 30, 30 and the transmitting faces 20*a*, and therefore, the rotational forces of the drive wheels 30, 30 can efficiently be converted to the drive force T also in this respect.

Figure 12:
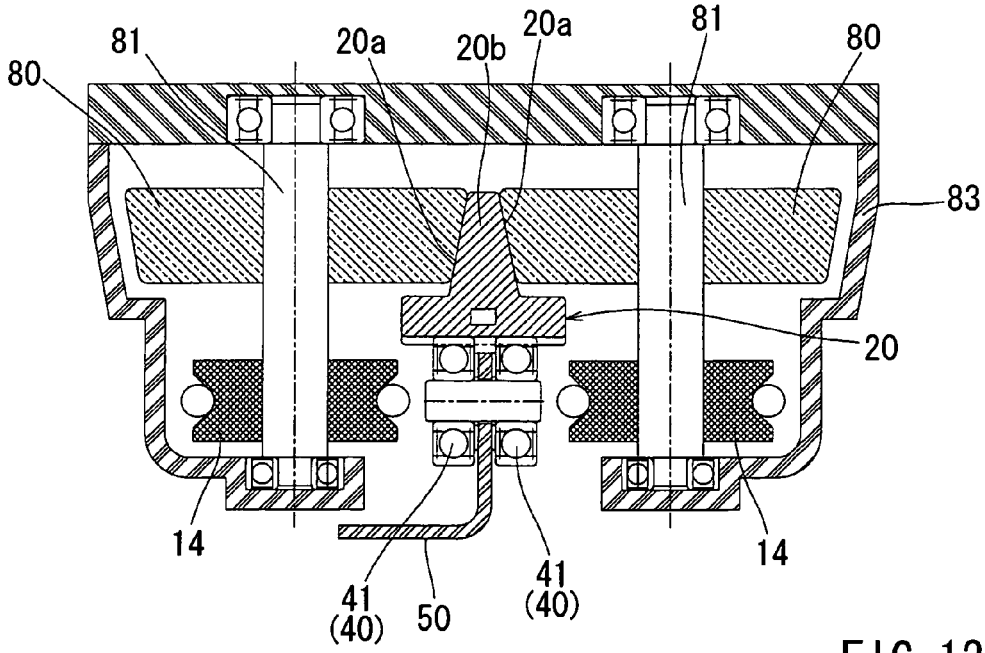
[FIG. 12]

The first embodiment explained above can variously be changed. For example, although according to the first embodiment, there is exemplified a constitution in which the rotational axis lines (axis lines of support shafts 31) of the left and right drive wheels 30, 30 are arranged in parallel with the transmitting faces 20*a*, 20*a* (arranged together in the V-shape), a construction of arranging support shafts 81, 81 of drive wheels 80, 80 in parallel with each other (second embodiment) may be possible as shown in FIG. 12. In the second embodiment, for members, constitutions that are similar to those of the first embodiment, the same reference signs are used and the explanation thereof will be omitted.

In the case of the second embodiment, peripheral faces of the drive wheels 80, 80 are configured to have cone shapes that are parallel with the transmitting faces 20*a*, 20*a* of the driver support base 20, and therefore, similar to the above-described embodiment, by bringing the transmitting portion 20*b* to wedge between the two drive wheels 80, 80 by pressing the driver support base 20 by the press mechanism 40, a large drive force T of the driver support base 20 can be achieved without causing slippage between them.

Further, in this case, the left and right support shafts 81, 81 are arranged in parallel with each other, and therefore, the fabrication cost with regard to accuracy in size or the like of a holder 83 fixed to the main body housing 10 can be reduced.

Figure 13:
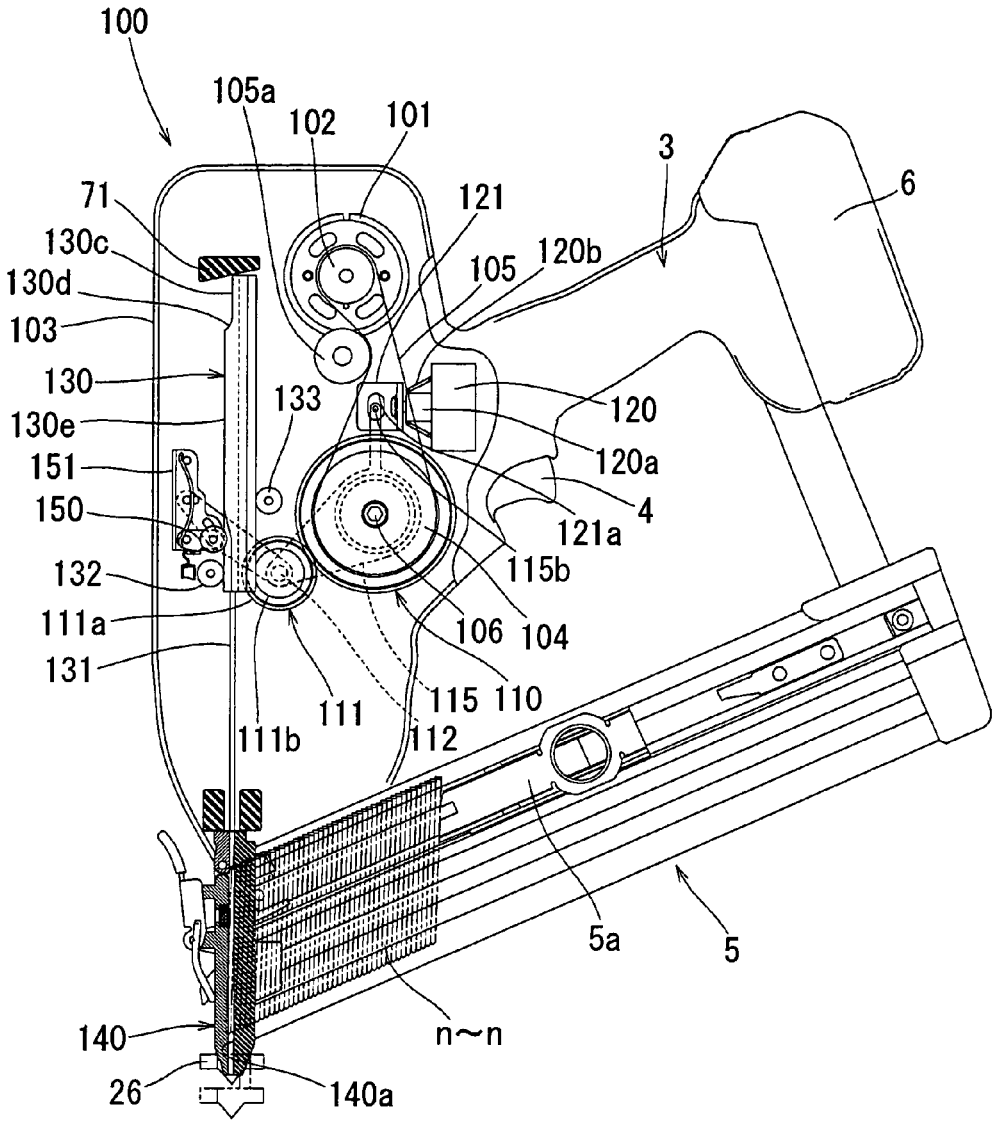
[FIG. 13]

Next, although in the first and the second embodiments explained above, there has been exemplified a constitution, in which the drive force T is transmitted due to clamping the transmitting portion 20*b* of the driver support base 20 by the drive wheels 30, 30 (80, 80) from the two left and right sides relative to the driving direction, a constitution is possible to transmit the drive force by bringing a drive wheel conversely with a peripheral edge portion of V-shape cross section to wedge a V-shaped groove provided at the driver support base (third embodiment). A driving tool 100 according to the third embodiment corresponds to an embodiment of the invention described in Claim 17 of the claims. The driving tool 100 according to the third embodiment is shown in FIG. 13. With regard to members and constitutions similar to those of the first and the second embodiments, the same reference signs are used and an explanation thereof will be omitted.

Figure 17:
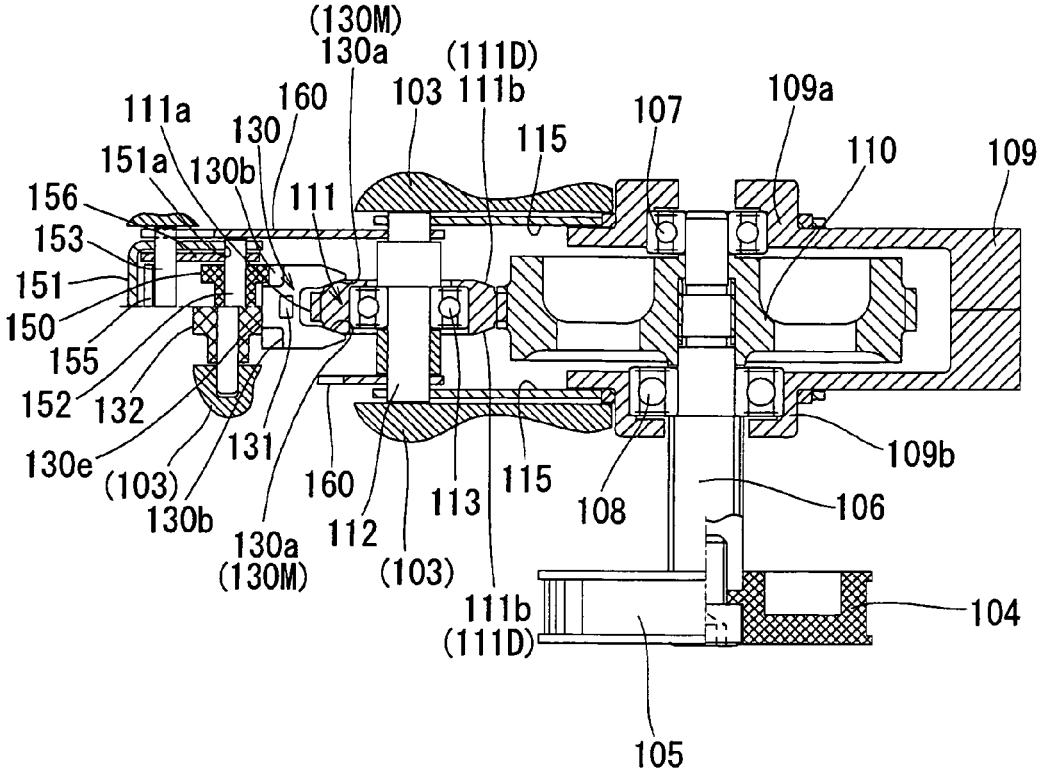
[FIG. 17]

Reference sign 101 in FIG. 13 designates an electric motor as a drive source. A drive pulley 102 is mounted to an output shaft of the electric motor 101. A driven pulley 104 is rotatably supported at the center of a main body housing 103 via a fixed support shaft 106. As shown in FIG. 17, the fixed support shaft 106 is rotatably supported by a holder 109 via bearings 107, 108. The holder 109 is fixed to the main body housing 103. Opposite side portions of the holder 109 are provided with recess portions 109*a*, 109*b*. The bearings 107, 108 are respectively held within the recess portions 109*a*, 109*b*.

A drive belt 105 extends between the driven pulley 104 and the drive pulley 102. The tension of the drive belt 105 is suitably set by adjusting a position of an idler 105*a*. The rotational force of the electric motor 101 is transmitted to the driven pulley 104 via the drive belt 105.

A drive gear 110 is attached onto the fixed support shaft 106 in addition to the driven pulley 104. Because the drive gear 110 and the driven pulley 104 are fixed onto the fixed support shaft 106, they rotate in unison with each other. Therefore, when the electric motor 101 is started, the drive gear 110 is rotated. A driven gear portion 111*a* of a drive wheel 111 is in mesh with the drive gear 110.

Further, opposite corner portions in a thickness direction of the drive wheel 111 are provided with inclined faces 111*b*, 111*b* arranged together in a V-shape and along the entire periphery thereof. The driven gear portion 111*a* is provided between the two inclined faces 111*b*, 111*b*.

The drive wheel 111 is rotatably supported onto a movable support shaft 112 by way of a bearing 113. As shown in FIG. 17, the movable support shaft 112 is supported between front end portions of two pivotal plates 115, 115 that can pivot vertically about a rotational axis of the fixed support shaft 106. The two pivotal plates 115, 115 are rotatably supported on the outer peripheral sides of the recess portions 109*a*, 109*b* of the holder 109. When the two pivotal plates 115, 115 pivot in the counterclockwise direction of FIG. 13, the drive wheel 111 shifts in a driving direction (lower direction of FIG. 13).

The two pivotal plates 115, 115 are respectively provided with operating arm portions 115*a* that are in a state of projecting in radial directions. The two operating arm portions 115*a*, 115*a* are integrally coupled by way of a connecting shaft 115*b*. On the other hand, the holder 109 has an electromagnetic actuator 120 attached thereto. The electromagnetic actuator 120 used herein is similar to the above-described electromagnetic actuator 42, and an output shaft 120*a* is urged in a projecting direction by a compression spring 120*b*. When an electric power is supplied to the electromagnetic actuator 120, the output shaft 120*a* makes a stroke movement toward a retracting side against the compression spring 120*b*. When the supply of power to the electromagnetic actuator 120 is shut off, the output shaft 120*a* is returned toward a projecting side by the compression spring 120*b*.

A bracket 121 is attached to a front end of the output shaft 120*a* of the electromagnetic actuator 120. The bracket 121 is provided with a connecting hole 121*a* elongated in a direction orthogonal to an extending and contracting direction of the output shaft 120*a*. The connecting shaft 115*b* is inserted into the connecting hole 121*a*. Therefore, when the electromagnetic actuator 120 is operated by the supply of power and the output shaft 120*a* is operated in a retracting direction against the compression spring 120*b*, the two pivotal plates 115, 115 are pivoted by a fixed angle in the clockwise direction of FIG. 13.

When the two pivotal plates 115, 115 are pivoted in the clockwise direction of FIG. 13, the drive wheel 111 is shifted in a direction opposite to a driving direction (upper direction in FIG. 13).

The main body housing 103 is provided with a driver support base 130 that is movable along a driving direction (vertical direction in FIG. 13) similar to the first and the second embodiments. The driver support base 130 is vertically movably supported in a state where both sides thereof are held between guide rollers 132, 133 that are rotatably provided at the main body housing 103. In the following explanation, a right side face of the driver support base 130 as viewed in FIG. 13 through FIG. 16 is referred to as a front face, and a left side face opposed thereto is referred to as a back face (or press face 130*e*). The guide roller 132 is in contact with a back face side of the driver support base 130, the guide roller 133 is in contact with a front face side, and the driver support base 130 is vertically movably guided by the two guide rollers 132, 133.

A driver 131 is attached to a lower face of the driver support base 130. The driver 131 is extended to be prolonged downwardly, and a front end side thereof extends into the driving hole 140*a* of the driver guide 140 attached to a lower face of the main body housing 103.

The front face side of the driver support base 130 is formed with two transmitting faces 130*a*, 130*a* inclined to each other in a V-shape along an entire length thereof. A peripheral edge of the drive wheel 111 is fitted between the two transmitting faces 130*a*, 130*a*, and the inclined faces 111*b* of the drive wheel 111 are respectively in contact with the two transmitting faces 130*a*, 130*a* in a line contact state.

As described above, the drive wheel 111 is supported between pivotal front end portions of the pivotal plates 115, 115 that pivot vertically by the electromagnetic actuator 120, and therefore, when the pivotal plates 115, 115 are shifted upwardly, the drive wheel 111 wedges between the drive gear 110 and the driver support base 130, so that the two inclined faces 111*b*, 111*b* are pressed respectively against the transmitting faces 130*a* of the driver support base 130.

By causing the peripheral edge portion of the drive wheel 111 to wedge between the pair of left and right transmitting faces 130*a*, 130*a* relative to the driving direction, which are provided at the driver support base 130, and pressing the inclined faces 111*b*, 111*b* arranged to each other in V-shape against the transmitting faces 130*a*, 130*a*, a large equivalent friction coefficient μ(e) can be provided similar to the first and the second embodiments, so that a large drive force T of the driver support base 130 can be achieved by efficiently transmitting the rotational force of the drive wheel 111, without need of high working accuracy, and therefore, a large striking force can be achieved.

The driving tool 100 according to the third embodiment is provided with a mechanism for pressing the driver support base 130 against the drive wheel 111 in addition to a mechanism for pressing the drive wheel 111 against the driver support base 130 as described above. Therefore, the driving tool 100 of the third embodiment is provided with a constitution of pressing V-grooves (transmitting faces 130*a*, 130*a*) of the driver support base 130 and the transmitting portions (inclined faces 111*b*, 111*b*) of the drive wheel 111 against each other.

The pair of press rollers 150, 150 are arranged on a lateral side of the driver support base 130 opposed to the drive wheel 111 (side of the guide roller 132). The press rollers 150, 150 are supported by a press bracket 151 attached to the main body housing 103. The press bracket 151 is supported by the main body housing 103 in a state where it can pivot in directions toward and away from the driver support base 130 via a fixed support shaft 154 at an upper portion thereof (left and right directions in FIG. 14, or directions orthogonal to the paper face of FIG. 17). A lower portion of the press bracket 151 is provided with a pivotal support shaft 153 that is parallel with the fixed support shaft 154. The press bracket 151 is provided with two press levers 156, 156 that is movable in the vertical direction (a direction orthogonal to paper face in FIG. 17) via the pivotal support shaft 153. The press rollers 150, 150 are rotatably supported by pivotal front end sides of the press levers 156, 156 by way of a press support shaft 152. The press levers 156, 156 are urged in a direction of pivoting downward by tension springs 157 extending between the press levers 156, 156 and the main body housing 103, respectively. The two press levers 156, 156 vertically pivot in unison since the press support shaft 152 couples between the front end portions.

Opposite end portions of the press support shaft 152 are inserted into arc-shaped groove portions 151*a* respectively provided at the press brackets 151. The press levers 156, 156 vertically pivot about the pivotal support shaft 153 within a range in which the press support shaft 152 is movable within the groove portions 151*a*.

Figure 14:
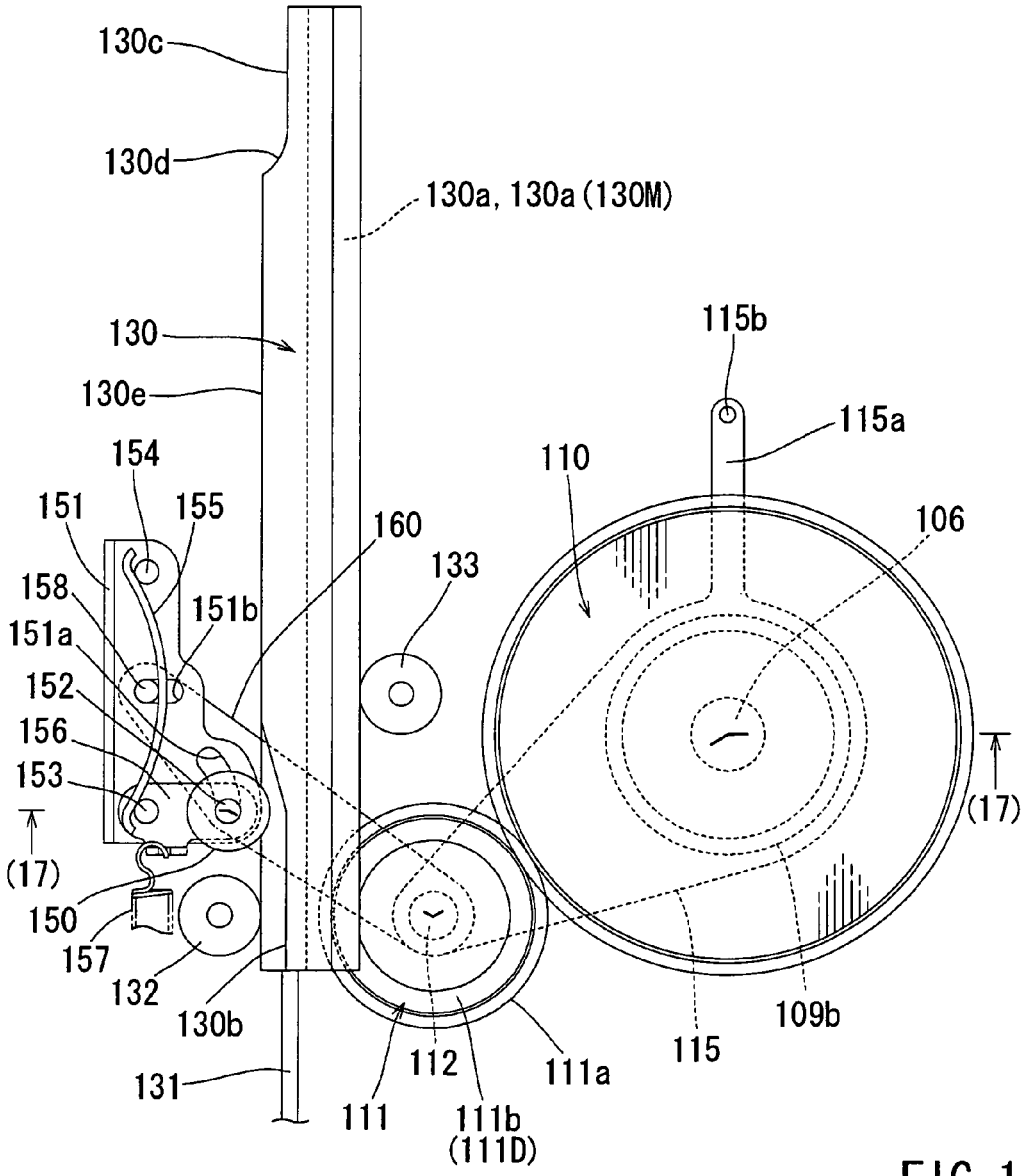
[FIG. 14]

As shown in FIG. 14, a leaf spring 155 extends between the fixed support shaft 154 and the pivotal support shaft 153. An operating pin 158 is disposed at a center of the leaf spring 155. The operating pin 158 is inserted into a groove hole 151*b* provided at a center of the press bracket 151. The groove hole 151*b* is formed to be elongated along a direction substantially orthogonal to the driving direction as illustrated.

The operating pin 158 is fixed between pivotal front end portions of pivotal levers 160, 160 vertically pivotally supported via the movable support shaft 112 that rotatably supports the drive wheel 111. Further, as shown in FIG. 14, the operating pin 158 is disposed on a left side of the leaf spring 155 (side opposed to the driver support base 130). In contrast thereto, the pivotal support shaft 153 and the fixed support shaft 154 are disposed on a right side of the leaf spring 155 (side of driver support base 130). Therefore, the leaf spring 155 is in a state where opposite end portions thereof are hooked to be engaged with the pivotal support shaft 153 and the fixed support shaft 154, while a center portion thereof is pressed in a bending direction by the operating pin 158.

By mounting the leaf spring 155 in a bent state in this way, the operating pin 158 normally receives an urge force in a direction away from the driver support base 130 (left direction in FIG. 14), and therefore, the urging force is applied to shift two press levers 160, 160 leftward in FIG. 14, thereby, the drive wheel 111 normally receives an urge force in a direction for wedging between the driver support base 130 and the drive gear 110 (upper direction in FIG. 14). By the urging force of the leaf spring 155, the two inclined faces 111*b*, 111*b* of the drive wheel 111 are in a state where they are respectively pressed by the transmitting faces 130*a*, 130*a* of the driver support base 130, so that a rotational force of the drive wheel 111 is transmitted to the driver support base 130.

Further, by the urging force of the leaf spring 155, the press bracket 151 is in a state where it is normally urged in a direction toward the driver support base 130 (right direction in FIG. 14). Therefore, the press rollers 150, 150 are urged normally in a direction for pressing against the press faces 130*e* of the driver support base 130 (right side in FIG. 14).

On the other hand, within a predetermined range of a lower side portion of the driver support base 130, both side portions of its back face side are formed with relief portions 130*b*, 130*b* at a level lower than their centers in correspondence with the two press rollers 150, 150. The press rollers 150, 150 are not pressed against the relief portions 130*b*, 130*b*. Further, as shown in FIG. 17, the guide roller 132 is in contact with the center portion of the press face 130*e* of the driver support base 130 at a position out of the two relief portions 130*b*, 130*b*. Therefore, even in a state where the two press rollers 150, 150 are pressed against the relief portions 130*b*, 130*b*, the guide roller 132 normally contacts with the press face 130*e* of the driver support base 130 and guides the driver support base 130 in the vertical direction.

Further, also on the back face side of an upper portion of the driver support base 130 and within a predetermined range, a relief portion 130*c* for not being pressed by the press rollers 150, 150 is provided. The relief portion 130*c* on the upper portion side is provided over the entire width in a width direction thereof (direction orthogonal to the paper face of the drawing).

According to the driving tool 100 of the third embodiment constituted as described above, when the front end of the driver guide 140 is brought to be close to the driven member W by moving the contact lever 26 relatively upward, the limit switch 27 is turned ON and the electric motor 101 is started. When the electric motor 101 is started to the driving side, the driven pulley 104 is rotated by way of the drive belt 105, and therefore, the drive gear 110 is rotated in unison therewith in the clockwise direction in FIG. 13. By the rotation of the drive gear 110, the drive wheel 111 is rotated in the counterclockwise direction in FIG. 13. On the other hand, when the switch lever 4 is operated to be pulled after starting the electric motor 101, the electromagnetic actuator 120 is operated in the direction for retracing the output shaft 120*a*. Therefore, the pivotal plate 115 pivots in the clockwise direction of FIG. 13 and the inclined faces 111*b*, 111*b* of the drive wheel 111 are respectively pressed against the transmitting faces 130*a* of the driver support base 130. The driver support base 130 is moved in the driving direction by a friction produced between the inclined faces 111*b*, 111*b* and the transmitting faces 130*a*, 130*a* of the driver support base 130 under the pressed state, so that the nail n is struck by the driver 131 and is driven out of the front end of the driver guide 140.

FIG. 13 and FIG. 14 show the standby state in which the driver support base 130 is not moved in the driving direction. In the standby state, the press rollers 150, 150 are in a state where they are positioned at the relief portions 130*b*, 130*b* of the driver support base 130 and are not pressed. Therefore, at an initial stage of starting to move the driver support base 130 in the driving direction, where the drive wheel 111 is rotated toward the driving side (counterclockwise direction in FIG. 13 and FIG. 14) by the operation of the electromagnetic actuator 120 as described above and the two inclined faces 111*b*, 111*b* are pressed respectively against the transmitting faces 130*a* of the driver support base 130, the two press rollers 150, 150 are positioned within the relief portions 130*b*, 130*b* and are in a floating state, and therefore, the driver support base 130 starts moving downward in the driving direction only by a clamping force (relatively weak drive force T) produced as it is clamped between the drive wheel 111 and the guide roller 132.

Figure 15:
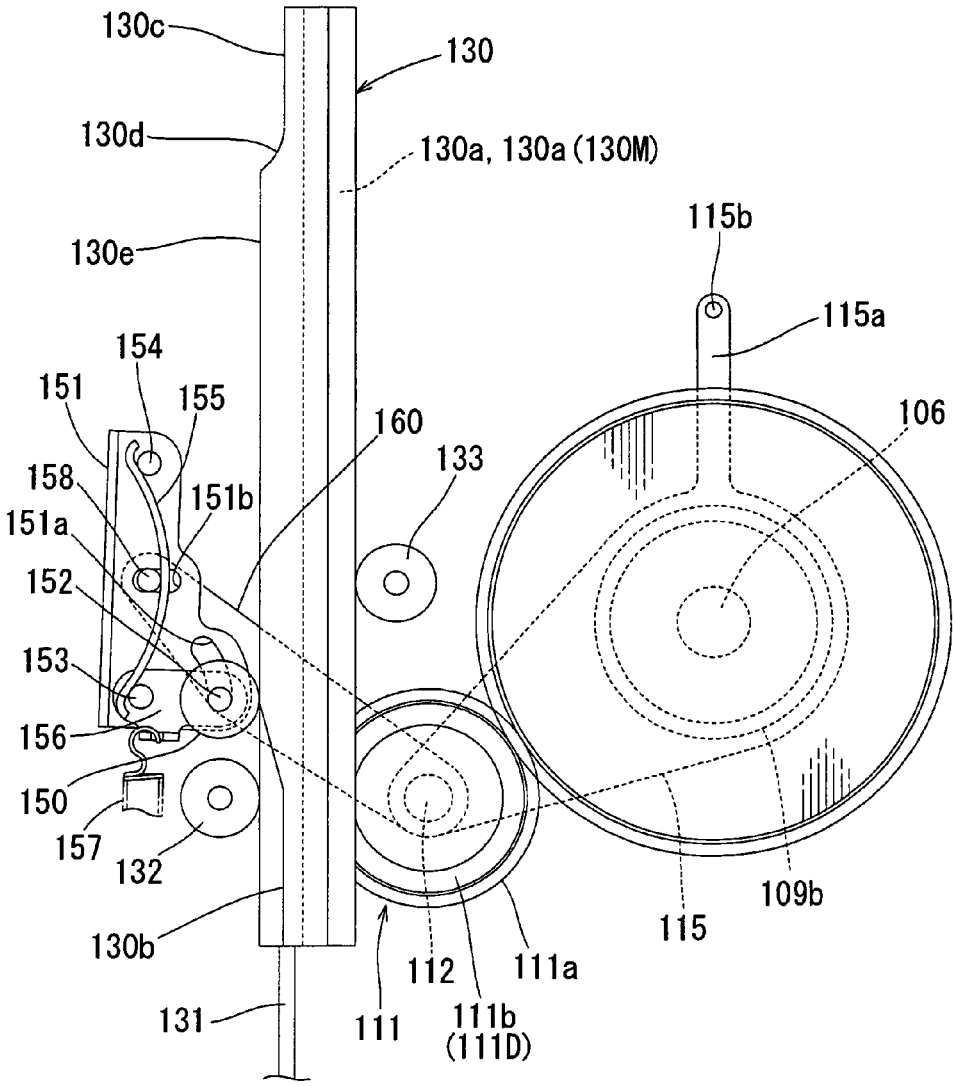
[FIG. 15]

After the driver support base 130 starts moving downward from the standby state, at a stage where it is moved downward by a predetermined distance as shown in FIG. 15, the two press rollers 150, 150 are out of the relief portions 130*b*, 130*b* and are respectively in contact with the press faces 130*e* of the driver support base 130. The two press rollers 150, 150 are pressed against the press faces 130*e* of the driver support base 130 by the urge force of the leaf spring 155. Therefore, the driver support base 130 is pressed against the side of the drive wheel 111, and by a reaction force thereof, the press bracket 151 is slightly pivoted in a direction away from the driver support base 130 about the fixed support shaft 154, so that the operating pin 158 is shifted in the same direction, or due to application of an external force for shifting in the same direction, the drive wheel 111 wedges between the driver support base 130 and the drive gear 110 by a lager force, t, and therefore, the inclined faces 111*b*, 111*b* of the drive wheel 111 are pressed against the transmitting faces 130*a*, 130*a* by a larger press force, and hence, the drive force T of the driver support base 130 is increased.

Figure 16:
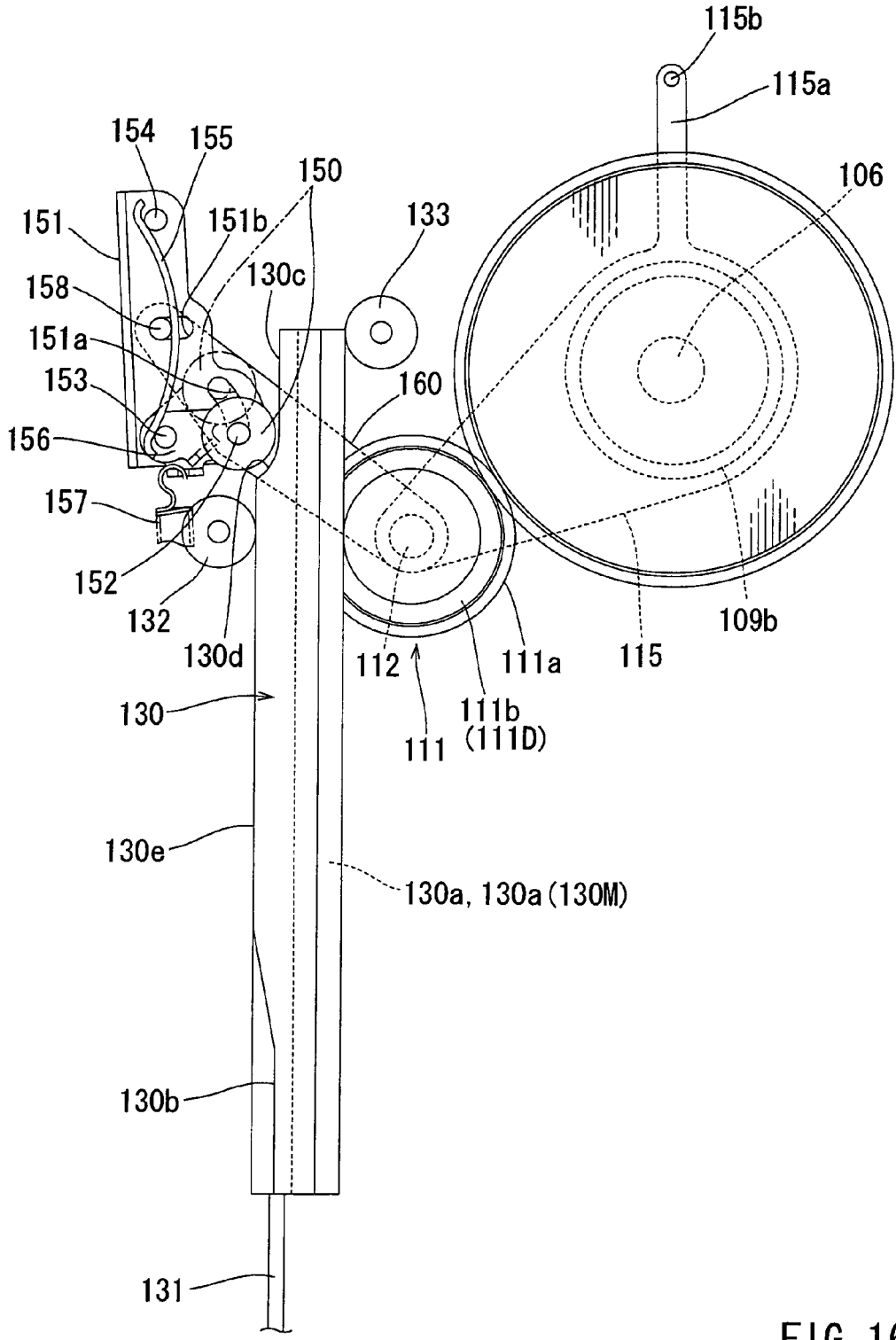
[FIG. 16]

During the period from the state shown in FIG. 15 to a state shown in FIG. 16, the drive wheel 111 is in a state where it firmly wedges between the driver support base 130 and the drive gear 110 by the drive force of the electromagnetic actuator 120 and the urge force of the leaf spring 155, and therefore, the driver support base 130 is moved downward by a large drive force T to drive the nail n.

When the driver support base 130 reaches a downward moving end after finishing to drive (strike) the nail n by the driver 131, the two press rollers 150, 150 reach the relief portion 130*c* on the upper portion side and the pressing state of the press rollers against the driver support base 130 is released. Further, normally, at this stage, the supply of power to the electromagnetic actuator 120 is automatically shut off by setting a timer to 0.07 second (it may be set to about 0.02 second), so that the output shaft 120*a* is returned to the projecting side by the compression spring 120*b*, and therefore, the external forces applied to the pivotal plates 115, 115 in a direction of shifting the drive wheel 111 toward the wedging direction is removed.

Because the urge force of the compression spring 155 applied to the drive wheel 111 in the wedging direction and the retracting force of the electromagnetic actuator 120 are released in this way, the strong wedging state of the drive wheel 111 between the driver support base 130 and the drive gear 110 is released, and the strong pressing state of the inclined faces 111*b*, 111*b* of the drive wheel 111 against the transmitting faces 130*a*, 130*a* is released, so that transmission of the drive force T to the driver support base 130 is released.

When the transmission of the drive force T to the driver support base 130 is released, the driver support base 130 is returned to the side of the upper standby position by the return rubbers 70, 70 and by their winding on the winding wheels 60, 60, similar to the first and second embodiments. When the driver support base 130 is moved upward and the upper end is brought into contact with the stopper 71, the driver support base 130 is brought into a state where it is returned to the standby position.

Further, during a process of returning the driver support base 130 to the upward moving end position (standby position) by the return rubbers 70, 70 while the contact lever 26 moves upward relatively and the electric motor 101 is started, it may be conceivable that the press rollers 150, 150 are pressed again against the press faces 130*e* of the driver support base 130 to cause the driver support base 130 to move downward by the rotation of the drive wheel 111 and to result so-to-speak double striking, however, the embodiment is configured to reliably prevent the double striking. That is, a lower portion of the relief portion 130*c* on the upper portion side of the driver support base 130 is provided with a guide face 130*d* for releasing the pressing state.

According to this guide face 130*d*, immediately after starting to move the driver support base 130 upward from the downward end position, the two press rollers 150, 150 interfere with the guide face 130*d*, and as the driver support base 130 moves upward in the interfered state, the press lever 156 pivots in the counterclockwise direction about the pivotal support shaft 153 against the tension spring 157.

The groove portion 151*a*, into which the press support shaft 152 supporting the two press rollers 150, 150 is inserted, is formed along an arc shifting in a direction away from the press face 130*e* of the driver support base 130, and therefore, as the press lever 156 pivots in the counterclockwise direction as illustrated, the two press rollers 150, 150 shift along the groove portion 151*a* and thus shift in a direction away from the driver support base 130. This state is indicated by two-dotted chain lines in FIG. 16.

In this way, because the two press rollers 150, 150 shift in the direction away from the press faces 130*e* of the driver support base 130, it is possible to avoid the driver support base 130 from being pressed again, so that the so-to-speak double striking can be reliably prevented.

When the driver support base 130 is returned to the upward moving end position, the two press rollers 150, 150 respectively reach the relief portion 130*b*, and therefore, the press arm 156 pivots again in the clockwise direction as illustrated by the tension spring 157, so that the two press rollers 150, 150 are returned to the initial positions shown in FIG. 14.

As explained above, also with the driving tool 100 of the third embodiment, the inclined faces 111*b*, 111*b* (V-shaped transmitting portion 111D) of the drive wheel 111 are pressed against the transmitting faces 130*a*, 130*a* (V-shaped transmitting groove 130M) of the driver support base 130 by a large press force, and due to a large equivalent friction coefficient achieved by this, it is possible to achieve a large striking force by moving the driver support base 130, and therefore, the driver 131 in the driving direction by a large drive force T. Therefrom, also by the driving tool 100 according to the third embodiment, similar to the first and the second embodiments, a large drive force T can be achieved without need of high working accuracy.

Further, according to the driving tool 100 of the third embodiment, at the initial stage of the downward movement of the driver support base 130, the press rollers 150, 150 are respectively positioned at the relief portion 130*b*, and therefore, the driver support base 130 is brought into a state where it is not pressed by the press rollers 150, 150, so that the driver support base 130 starts moving downward by a small drive force T, and hence, a smooth operating state of the driving tool 100 can be ensured. On the other hand, at a stage of driving the nail n by the driver 131 (stage of driving nail n), the two press rollers 150, 150 are positioned out of the relief portion 130*b* and are pressed against the press faces 130*e* of the driver support base 130, and therefore, the inclined faces 111*b* of the drive wheel 111 are respectively pressed against the transmitting faces 130*a*, 103*a* of the driver support base 130 by a large force, so that a large drive force T can be achieved.

Further, the relief portion 130*c* is provided also at the upper end portion of the back face of the driver support base 130. According to the relief portion 130*c*, at a stage where the nail n is finished to be driven and the driver support base 130 reaches the downward moving end, the two press rollers 150, 150 are positioned at the relief portion 130*c* and are brought into the state where they are not pressed against the driver support base 130, and therefore, also in this case, the state, where the strong wedging state of the drive wheel 111 into the V-groove formed by the transmitting faces 130*a*, 130*a* is substantially released, is brought about. Therefore, at the stage of returning the driver support base 130 to the standby position, the operation of returning the driver support base 130 by the return rubbers 70, 70 and the winding wheels 60, 60 can smoothly be carried out.

Further, according to the driving tool 100 of the third embodiment, no slippage in the rotational direction is caused between the drive wheel 111 and the drive gear 110 due to meshing of the driven gear portion 111*a* of the drive wheel 111 and the drive gear 110 with each other, and therefore, the drive wheel 111 can be reliably wedged between the drive gear 110 and the driver support base 130, and therefore, a large drive force T can be achieved by causing the peripheral edge portion of the drive wheel 111 to firmly wedge into V-groove portion formed by the transmitting faces 130*a*, 130*a*.

Also the third embodiment explained above can variously be changed. For example, although there has been exemplified the constitution, in which the rotational force is transmitted through meshing of the drive gear 110 and the driven gear portion 111*a* of the drive wheel 111 with each other, it may be possible to construct to transmit the rotational force by a friction between them.

Further, it may be possible to construct to omit the driven pulley 104 and the drive gear 110 and to transmit the rotational force by arranging the drive belt 105 to extend directly around the drive wheel 111. Also with this constitution, the peripheral edge portion of the drive wheel 111 can be brought to wedge between the transmitting faces 130*a*, 130*a* of the driver support base 130 as the pivotal plates 115, 115 pivot by the operation of the electromagnetic actuator 120.

Further, although there has been exemplified the constitution, in which the two press rollers 150, 150 are pressed against the opposite side portions of the press faces 130*e* of the driver support base 130 and the guide roller 132 rolls between them, it may be possible to conversely construct such that two guide rollers roll on the opposite side portions of the press faces 130*e* of the driver support base 130 and one press roller presses between them while it rolls. In the case of this constitution, it may be constructed to provide a relief recess portion at the center with respect to a width direction of the press face of the driver support base.

Further, although a driving tool of battery type has been exemplified, it is possible to apply similarly to a driving tool operating by an alternating current power source as a power source. Further, although the driving tool for driving the nail n has been exemplified, it is applicable similarly to other driving tools, such as a tacker or the like.

The invention claimed is:

1. A driving tool comprising a pair of drive wheels rotatably driven in directions opposed to each other by an electric motor, a driver support base movable in a driving direction by a rotational force of the drive wheels while a transmitting portion is clamped between the pair of drive wheels, and a driver attached to the driver support base for striking a driven member, wherein the transmitting portion of the driver support base has a V-shape in cross section and includes transmitting faces, with which the drive wheels contact, respectively, and the driver support base can be pressed by a press member in such a direction that the transmitting portion is wedged between the two drive wheels.

2. The driving tool according to claim 1, wherein the pair of drive wheels are supported to be rotatable about rotational axes parallel with the transmitting faces of the driver support base, and peripheral faces parallel with the rotational axes are in contact with the transmitting faces of the driver support base.

3. The driving tool according to claim 1, wherein the pair of drive wheels are rotatable about rotational axes parallel with each other, the drive wheels have peripheral faces formed as conical faces inclined relative to the respective rotational axes and the peripheral faces are in contact with the transmitting face of the driver support base.

4. The driving tool according to claim 1, comprising a single electric motor as the drive source, wherein the driving tool is configured to rotate the pair of drive wheels by the single electric motor.

5. The driving tool according to claim 4, wherein the driving tool is configured to rotate the drive wheels in directions opposed to each other and simultaneously at the same rotational speed by a single drive belt extending between a drive pulley attached to an output shaft of the electric motor and driven pulleys provided on the pair of drive wheels, respectively.

6. A driving tool comprising a drive wheel rotatably driven by an electric motor, a driver support base movable in a driving direction by a rotational force of the drive wheel, and a driver attached to the driver support base for striking a driven member, wherein the drive wheel includes a transmitting portion formed in a V-shape in cross section by a pair of inclined faces over an entire periphery thereof, the driver support base includes a transmitting groove having a pair of transmitting faces arranged in a V-shape in cross section, and the transmitting portion of the drive wheel can be wedged into the transmitting groove to press the pair of inclined faces against the transmitting faces of the transmitting groove, so that the driver support base can be moved in the driving direction by a rotational force of the drive wheel.

7. The driving tool according to claim 6, wherein the drive wheel moves toward the driver support base for causing the transmitting portion to wedge into the transmitting groove.

8. The driving tool according to claim 7, wherein the drive wheel integrally includes a driven gear portion, a drive gear in mesh with the driven gear portion is rotated by the electric motor, so that the drive wheel is rotated in a direction for moving the driver support base in the driving direction.

9. The driving tool according to claim 8, wherein a pivotal plate is provided to be able to pivot about the same axis as the drive gear, the drive wheel is rotatably supported by a pivotal front end side of the pivotal plate, the pivotal plate is pivoted by the operation of the electromagnetic actuator, so that the transmitting portion of the drive wheel is wedged into the transmitting groove of the driver support base.

10. A driving tool comprising:

first and second drive wheels rotatably driven in directions opposed to each other by an electric motor;

wherein the first and second drive wheels have peripheral faces inclined relative to each other;

a driver support base movable in a driving direction by rotational forces of the first and second drive wheels and having a transmitting portion;

wherein the transmitting portion has first and second transmission faces inclined relative to each other;

a driver attached to the driver support base for striking a driven member in the driving direction; and a moving device configured to be able to move the drive support base in such a direction that the first transmission face frictionally contacts the peripheral face of the first drive wheel and the second transmission face frictionally contacts the peripheral face of the second drive wheel.

11. A driving tool comprising:

a drive wheel rotatably driven by an electric motor;

a driver support base movable in a driving direction by a rotational force of the drive wheel;

a driver attached to the driver support base for striking a driven member in the driving direction, wherein the drive wheel includes a transmission face extending along an entire periphery of the drive wheel; and wherein the transmission face has a V-shape in cross section in a radial direction;

wherein the driver support base includes a groove having a V-shape in cross section in a direction transverse to the driving direction, so that the transmission face can wedge into the groove of the driver support base for transmitting the rotation of the drive wheel to the driver support base.

* * * * *